US005335452A

United States Patent [19]

Taylor

[11] Patent Number: 5,335,452

[45] Date of Patent: Aug. 9, 1994

[54] HURRICANE PANEL APPARATUS

[76] Inventor: Alva R. Taylor, 206 SE. 10th St., Apt. 101, Dania, Fla. 33004

[21] Appl. No.: 100,447

[22] Filed: Aug. 2, 1993

[51] Int. Cl.[5] ..... E06B 3/32

[52] U.S. Cl. ..... 49/463; 49/57; 49/61; 52/202

[58] Field of Search ..... 49/50, 57, 61, 62, 460, 49/463, 464; 52/202, 203

[56] References Cited

U.S. PATENT DOCUMENTS

| | | | |
|---|---|---|---|
| 2,012,388 | 8/1935 | Goodman | 189/64 |
| 2,622,285 | 12/1952 | Roos | 52/202 |
| 2,772,447 | 12/1956 | Preston | 49/464 |
| 3,340,650 | 9/1967 | Sackett, Sr. | 49/463 |
| 3,376,669 | 4/1968 | Johnston | 49/463 X |
| 3,381,416 | 5/1968 | DeTorres et al. | 49/464 |
| 3,458,954 | 8/1969 | Roos | 49/62 |
| 3,745,704 | 7/1973 | Covington | 49/57 |
| 3,948,308 | 4/1976 | Facey | 160/369 |
| 4,221,091 | 9/1980 | Ganse et al. | 49/61 X |
| 4,333,271 | 6/1982 | DePaolo et al. | 49/464 |
| 4,495,978 | 1/1985 | Carroll | 160/117 |
| 4,562,666 | 1/1986 | Young, III | 49/463 X |
| 4,685,261 | 8/1987 | Seaquist | 52/202 |

*Primary Examiner*—Philip C. Kannan
*Attorney, Agent, or Firm*—Oltman and Flynn

[57] ABSTRACT

A storm shutter apparatus for protectively covering openings in buildings such as windows and doors includes a panel member for fitting over a building opening, a brace member having an end and extending across the panel member, and an assembly for removably securing the end of the brace member to the building adjacent to the building opening. The assembly for removably securing preferably includes an anchor member for attaching to the building, two spaced-apart leg members extending from the anchor member for receiving between them the end of the brace member, and a retaining member for extending over the end of the brace member for retaining the end between the leg members. The brace member may be a unified part of the panel member, attached to the panel member or a separate member placed over the panel member.

16 Claims, 4 Drawing Sheets

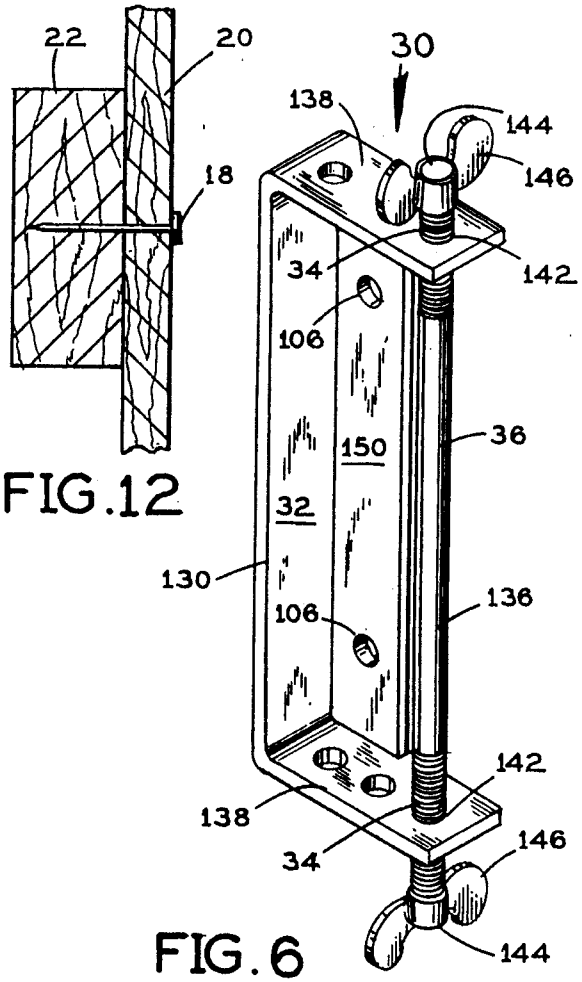
FIG. 6
FIG. 12
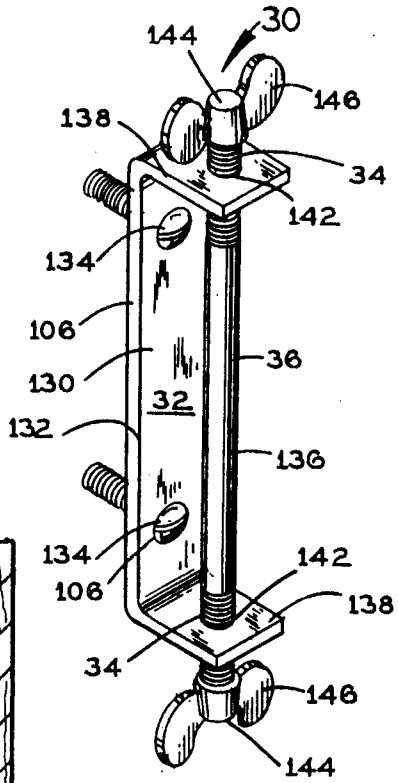
FIG. 5
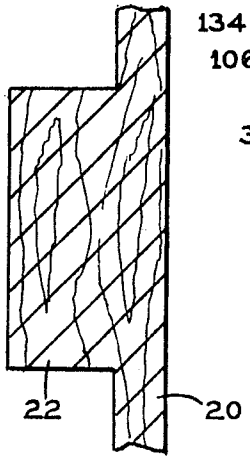
FIG. 11
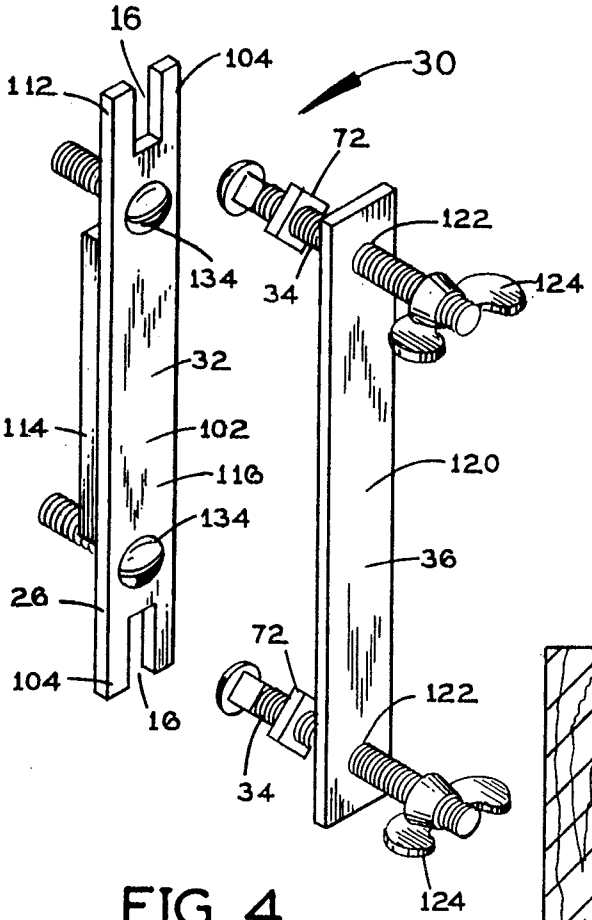
FIG. 4

HURRICANE PANEL APPARATUS

BACKGROUND OF THE INVENTION

1. Field of the Invention

The present invention relates generally to the field of shutters for protectively covering openings of buildings such as doors and windows, and more specifically to a storm shutter which includes a panel member for fitting over a building opening and one or more elongate brace members extending across the panel member. An assembly for removably securing each end of each brace member is provided adjacent to or within the building opening. Several variations of the assembly are provided, each essentially including an anchor member for attachment to the building adjacent to a building opening, two spaced-apart leg members extending from the anchor member for receiving between them an end of a brace member, and a retaining member extending between the leg members. The retaining member extends over an end of a brace member for retaining the brace member between the leg members and against the anchor member. A brace member may be a unified part of, or may be attached to, the panel member, but is preferably a separate member placed over the panel member.

2. Description of the Prior Art

There have long been shutter structures for covering building openings to keep out storm winds, intruders and other harmful phenomena.

Carroll, U.S. Pat. No. 4,495,978, issued on Jan. 29, 1985, discloses shutter panels for providing insulation over building openings. Rails are mounted on the building above and below an opening, and an outer panel section rides within either end of these rails. Inner panel sections are connected in series to each outer panel section with hinges so that they can be pivoted on the hinges toward the opposing outer panel section, meeting at the middle of the opening. A problem with Carroll is that several panel sections joined together with hinges and clasps can buckle, and generally lack the strength of a single solid panel. The several tongue and groove interlocking panels and the aligned rails make Carroll relatively expensive to make and install.

DePaolo, U.S. Pat. No. 4,333,271, issued on Jun. 8, 1982, teaches a hurricane panel security device including a guide channel attached along the top of a building opening and a ledge protruding along the bottom. Corrugated panel sections fit within the guide channel and rest against the ledge. The vertically-oriented corrugations of adjacent sections overlap to lock the panel sections together. A series of fastening clips secure the sections along the ledge, and a locking bar member anchors the fastening clips against removal. A problem with DePaolo is that critical time can be lost assembling composite panels from multiple separate sections and securing each with clasps. Another problem is that the corrugations can act as baffles in storm gusts, creating unnecessary and dangerous pressure against the panels. Still another problem is that the relatively complex structure would be expensive to manufacture.

Seaquist, U.S. Pat. No. 4,685,261, issued on Aug. 11, 1987, reveals a storm shutter structure including panels retained by top and bottom channel members which are attached above and below a building opening, respectively. The bottom channel member has a lower flange which resiliently angles downward to seat flush against an inclined window ledge. The several panels are Joined together by H-shaped connecting bars. Problems with Seaquist include loss of time in connecting panels together, the inherent weakness of separate panels joined edge to edge, and the tendency of the lower channel to collect debris when not in use.

Facey, U.S. Pat. No. 3,948,308, issued on Apr. 6, 1976, discloses a removable storm window which is formed of several panel sections joined together by hinges. The panel sections are folded together, fit through a window frame from inside the building, and unfolded across the outside of the window opening. Then the composite panel or storm window is anchored to the window frame with several turnbuckles hooked to brackets on the panels and to eye-screws fastened around the window frame. A problem with Facey is that, once again, a composite panel structure is weaker than a single solid panel. Another problem is that turnbuckles can be awkward to adjust to a mutual acceptable tension on the composite panel. Still another problem is that many windows, such a jalousies, do not provide the access needed to fit the folded panels through the window opening or to adjust turnbuckles.

Covington, U.S. Pat. No. 3,745,704, issued on Jul. 17, 1973 reveals a storm shutter installation including a panel member retained within guide channels mounted above and below a building opening. The panel member is fit up into the upper channel, swung over the lower channel, and lowered into the lower channel. The channels may be resilient So that they snap over protrusions on the panel member. A problem with Covington is that the channels must be carefully spaced apart and mutually aligned to receive a panel member according this procedure. The required care in installation would increase installation time and costs and would create the risk of the panels not fitting properly under emergency conditions.

Roos, U.S. Pat. No. 3,458,954, issued on Aug. 5, 1969, discloses a safety window covering apparatus for reflecting some of the intense heat radiated by a nuclear explosion, and to seal against radioactive gases. Roos includes a flange mounted around the periphery of a window and a reflective panel member which fastens to the flange. A problem with Roos is that the flange can be conspicuous and unsightly and may interfere with the normal operation of many types of windows.

De Torres, U.S. Pat. No. 3,381,416, issued on May 7, 1968, teaches a two-piece storm window. The upper window portion has holes along its top edge which are engaged by hook members on the upper sash. The lower window portion telescopes downward from the upper window portion and latches to the window sill area. A problem with De Torres is that the two-part structure is not as strong as a single, solid panel. Another problem is that the hooks could slide out of the holes under severe storm conditions, and the storm windows fall away from the window opening.

Goodman, U.S. Pat. No. 2,012,388, issued on Aug. 27, 1935, reveals a storm shutter. The shutter includes a frame or sash attached with hinges around a building opening and having protruding studs, and a panel with elongate ports to fit over the studs. The ports are narrow at the top to be retained behind the heads of the bolts. A problem with Goodman is that the sash may prove unattractive and conspicuous when the shutter panels are not in use. Another problem is that the panels could become dislodged if simply bumped upward during the chaos of a storm.

It is thus an object of the present invention to provide a panel apparatus for protectively covering building openings which is solid and strong and highly resistant to buckling and dislodging.

It is another object of the present invention to provide such a panel apparatus which can be installed rapidly and easily.

It is still another object of the present invention to provide such a panel apparatus which leaves inconspicuous structure on the building when the panel members are removed.

It is finally an object of the present invention to provide such a panel apparatus which is reliable, durable and relatively inexpensive to manufacture.

SUMMARY OF THE INVENTION

The present invention accomplishes the above-stated objectives, as well as others, as may be determined by a fair reading and interpretation of the entire specification.

A storm shutter apparatus is provided for protectively covering openings in buildings such as windows and doors, including a panel member for fitting over a building opening, a brace member having an end and extending across the panel member, and an assembly for removably securing the end of the brace member to the building adjacent to the building opening. The assembly for removably securing preferably includes an anchor member for attaching to the building, two spaced-apart leg members extending from the anchor member for receiving between them the end of the brace member, and a retaining member for extending over the end of the brace member for retaining the end between the leg members. The brace member may be a unified part of the panel member, attached to the panel member or a separate member placed over the panel member.

In an alternative embodiment, the anchor member is an angle iron plate, having a first angle portion for abutting a window frame fitted within the building opening, a second angle portion substantially perpendicular to the first angle portion for abutting an inner edge of the building opening, a fastener for fastening the second angle portion to the inner edge, and a shelf portion extending from the second angle portion and spaced-apart from and substantially parallel to the first angle portion and having two shelf ends and a shelf opening at each shelf end, where the leg members are bolts extending through the shelf openings away from the frame, the brace member fitting between the bolts and against the shelf portion, and where the retaining member is a plate having plate openings for receiving the leg members, and nuts for fastening the retaining member over the brace member. The retaining member preferably has a wider portion for extending between the leg members and extending around the anchor member, and a narrower portion with flanges at each end for fitting around the end of the brace member for more secure gripping of the brace member. The nuts for fastening the retaining member are preferably wing nuts for securing without the need for a tool.

In another alternative embodiment, the anchor member includes an elongate plate having two anchor ends and an anchor port in each of the two anchor ends, and having a first face against which a spacer member is placed, the spacer member being shorter than the anchor member and the two anchor ends extending axially beyond the spacer member, the spacer member abutting a wall of the building adjacent to the opening, the elongate plate also having a second face against which the end of the brace member is placed, where the leg members are bolts extending through the anchor ports away from the wall of the building, and where the retaining member is also an elongate plate having two retaining member ends and a hole in each retaining member end through which the leg members are fitted, and including bolts for fitting onto the leg members to fasten the retaining member over the leg members to hold the brace member in place.

Another alternative embodiment includes a U-shaped plate where the anchor member includes the bottom segment of the plate, and anchor ports are provided in the bottom segment of the plate through which wall anchor elements extend, and the side segments of the U-shape include the leg members, the leg members having opposing leg openings spaced out from the bottom segments, and where the retaining member is a rod member extending through the leg openings. The rod member preferably has two rod ends and threads on each rod end over which nuts are fastened to laterally abut the leg members.

An alternative embodiment includes a U-shaped plate where the anchor member includes the bottom segment of the plate and a wall portion extending substantially perpendicular to and along an edge of the bottom segment, and anchor ports are provided in the right angle portion through which wall anchor elements extend, where the leg members include the side segments, the leg members having opposing leg openings spaced-apart from the bottom segment, and where the retaining member is a rod member extending through the leg openings.

In another alternative embodiment, the anchor member includes an elongate plate having several anchor ports for receiving wall anchor elements, and having a first face for abutting a wall of the building adjacent to the opening, the elongate plate also having a second face against which the end of the brace member is placed, where the leg members include two spaced-apart and internally threaded tube segments projecting substantially perpendicularly from the second face and two bolts for screwing into the tube segments, and where the retaining member includes an elongate plate having two retaining member ends and a hole in each retaining member end through which the two bolts are fitted to fasten the retaining member over the tube segments to hold the brace member in place. The anchor member preferably additionally includes a wall angle portion extending substantially perpendicularly from the plate.

In still another alternative embodiment, the anchor member includes an elongate wall plate having several anchor ports for receiving wall anchor elements, and a connecting plate extending substantially perpendicularly from the wall plate and having a first face for abutting a wall of the building adjacent to the opening, the elongate plate also having a second face against which the end of the brace member is placed, where the leg members include two spaced-apart and internally threaded tube segments projecting substantially perpendicularly from the second face and two bolts for screwing into the tube segments, and where the retaining member includes an elongate plate having two retaining member ends and a hole in each the retaining member end through which the two bolts are fitted to fasten the retaining member over the tube segments to hold the brace member in place.

In another alternative embodiment, the anchor member includes an elongate plate having several anchor ports for receiving wall anchor elements, and having a first face for abutting a wall of the building adjacent to the opening, the elongate plate also having a second face against which the end of the brace member is placed, where the leg members include two spaced-apart and internally threaded tube segments projecting substantially perpendicularly from the second face and two bolts each having a diametrical bore for screwing into the tube segments, and where the retaining member is a rod member fitting through the diametrical bores in the bolts having a fastener at one end to secure the rod member within the diametrical bores to retain the rod member over the tube segments to hold the brace member in place.

In still another embodiment, the anchor member includes a wall plate having an anchor bore extending there-through and a substantially perpendicular connecting plate attached to it and having two anchor ends and an anchor opening in each of the two anchor ends, and having a first face against which a spacer member is placed, the spacer member being shorter than the anchor member and the two anchor ends extending axially beyond the spacer member, the spacer member abutting a wall of the building adjacent to the opening, the elongate plate also having a second face against which the end of the brace member is placed, where the leg members are bolts extending through the anchor openings away from the wall of the building, and where the retaining member is also an elongate plate having two retaining member ends and a hole in each retaining member end through which the leg members are fitted, and bolts for fitting onto said leg members to fasten the retaining member.

BRIEF DESCRIPTION OF THE DRAWINGS

Various other objects, advantages, and features of the invention will become apparent to those skilled in the art from the following discussion taken in conjunction with the following drawings, in which:

FIGS. 3–10 are perspective views of the remaining preferred embodiments of the inventive retaining assembly.

FIG. 11 is a partial cross-sectional side view of a brace member and panel member formed as a unified structure.

FIG. 12 is a partial cross-sectional side view of a brace member attached with nails to the panel member.

DETAILED DESCRIPTION OF THE PREFERRED EMBODIMENTS

Figure 1:
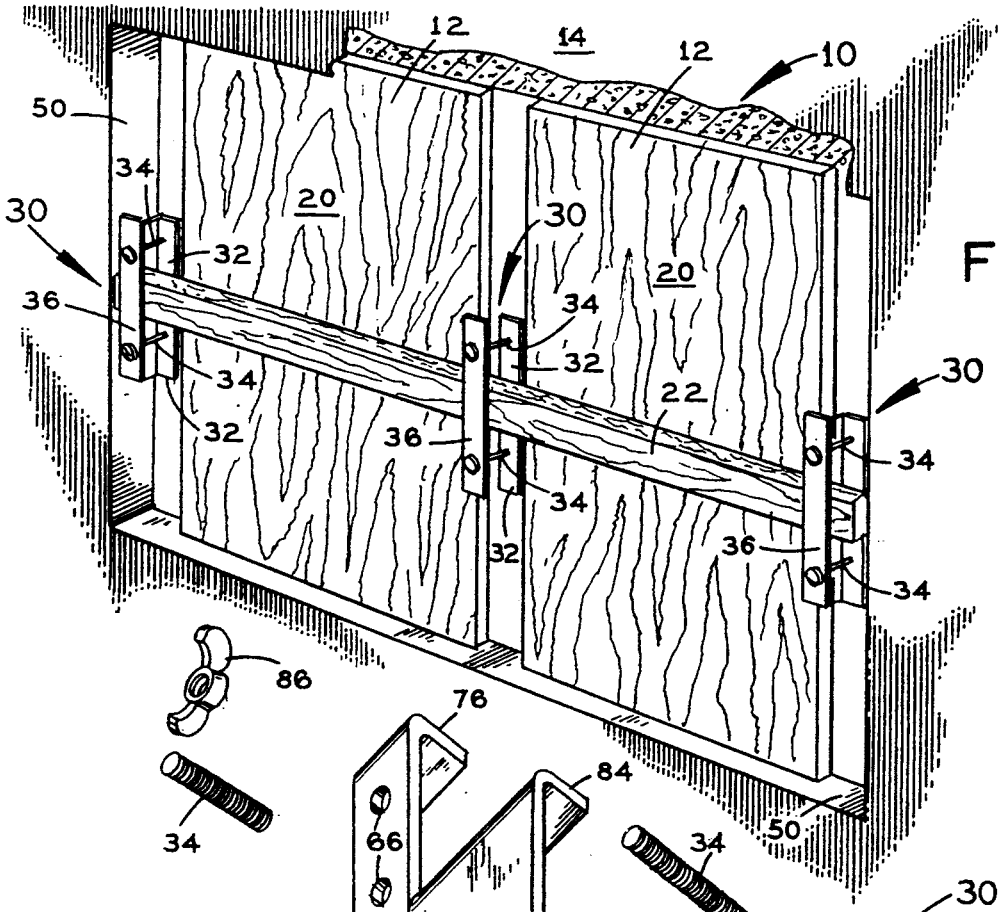
FIG. 1 is a perspective view of a window equipped with one embodiment of the inventive panel apparatus.
Figure 2:
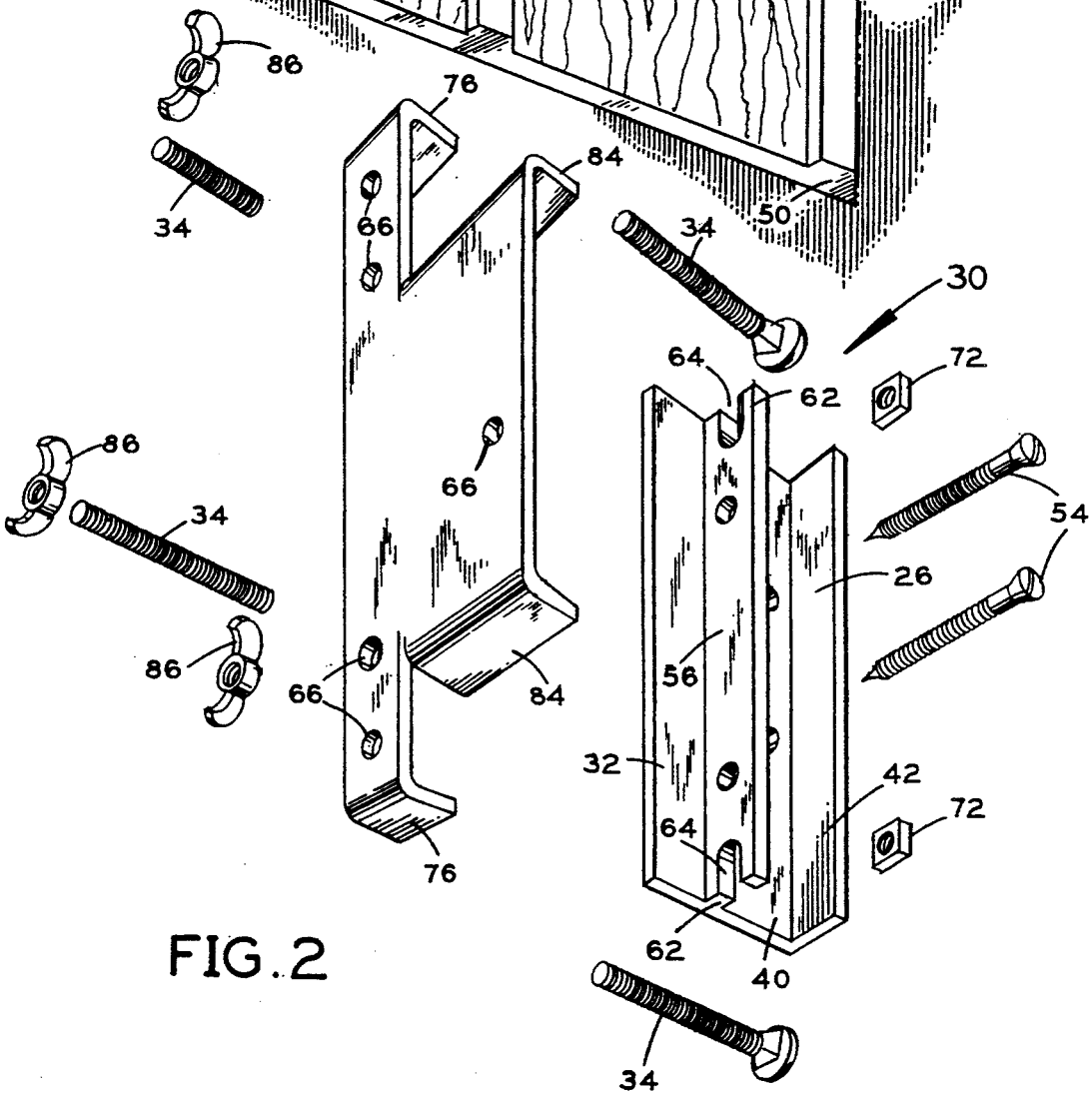
FIG. 2 is an exploded perspective view of the first preferred embodiment of the inventive brace member retaining assembly.
Figure 3:
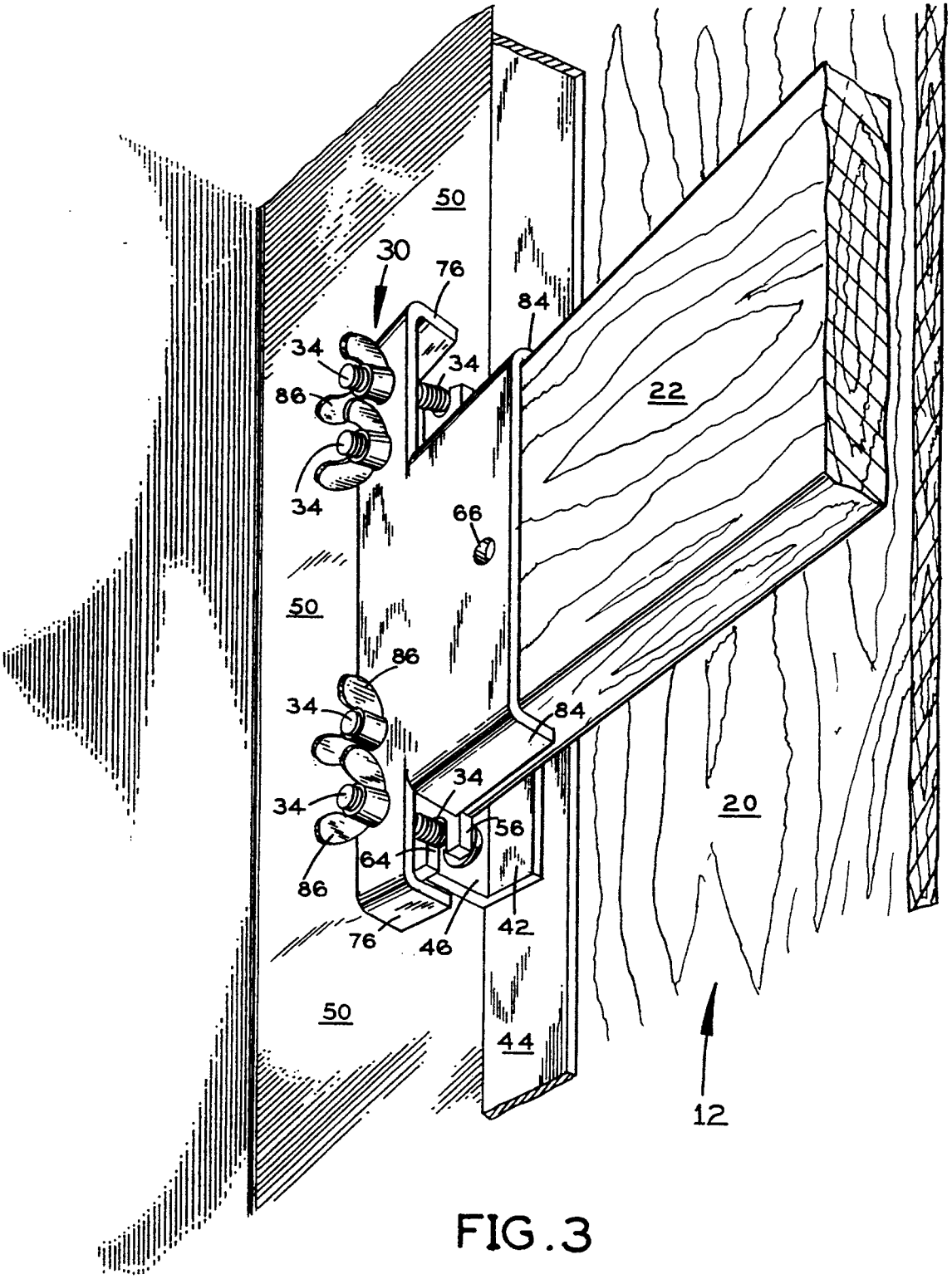

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

Preferred Embodiments

Referring to FIGS. 1–10, a storm shutter apparatus 10 is disclosed for protectively covering openings 12 in buildings 14 such as windows and doors. Apparatus 10 preferably includes a panel member 20 for fitting closely within a building opening 12 and one or more elongate brace members 22 extending across panel member 20. An existing door may serve as panel member 20. Each brace member 22 may be a unified part of, or may be attached to, panel member 20, but is preferably a separate member placed over panel member 20. A brace member 22 constitutes a unified part of panel member 20 where brace member 22 and panel member 20 are formed as one and the same piece of material, or in other words where they are a single monolithic structure. This forming may be by cutting brace member 22 and panel member 20 from a single piece of material or by molding brace member 22 and panel member 20 as a single piece. A brace member 22 may be attached to a panel member 20 with any of several well known fastening means, including nails 18, screws, and bolts. An assembly 30 for removably securing each end of each brace member 22 is attached adjacent to the building opening 12. See FIG. 1.

Fundamental Elements Common to All Embodiments

Several variations of assembly 30 are disclosed below, all having certain fundamental elements in common so that they perform equivalent functions. First, some part of assembly 30 is necessarily anchored to the building 14 near opening 12 to hold assembly 30 in place. This part is an anchor member 32. Anchor member 32 is secured to the building 14 with fastening or other means. Brace member 22 is placed across anchor member 32. A leg member 34 is fastened to anchor member 32 on either side of brace member 22 to secure brace member 22 against lateral movement. Then a retaining member 36 is positioned over brace member 22 and fastened to leg members 34. In this way, the various parts of assembly 30 completely surround the circumference of brace member 22, holding brace member 22 against movement in all lateral directions. All assemblies 30 are essentially two-stage, in that a portion including the anchor member 32 attaches to the building wall, then another portion, including the retaining member 36, is placed over the first portion to hold brace member 22.

Categories of Structural Variations

Although the various embodiments of assembly 30 have the above structural elements in common, these embodiments may be divided into general categories. The first broad category is for use around openings 12 where windows or doors are substantially flush with the building 14 wall. See FIGS. 4, 5, 7 and 9. In this instance, anchor members 32 attach to exterior surfaces of the building walls, so that brace members 22 pass over panel members 20 as well as the wall outer surface. Leg members 34 fasten to this type of anchor member 32 in essentially two different ways. One way is by passing each through a leg slot or leg hole 16 in anchor member 32 and fastening each with a nut or bolt head 72 on the wall side of anchor member 32. A working space 26 between anchor member 32 and the wall must be provided in which the fastening nuts 72 can be inserted and secured. This working space 26 may be provided at each end of anchor member 32 by placing a spacer member 114 shorter than anchor member 32 between the wall and anchor member 32. The leg hole or leg slot 16 for each leg member 34 is located beyond spacer member 114, over the working space 26 between anchor member 32 and the wall. Alteratively to the spacer member 114, internally threaded leg receiving tube segments 152 may be welded or glued to the outward facing surface of anchor member 32. For this variation, no working space 26 is required, because leg members 34 do not pass through anchor member 32.

A second broad category of assembly 30 is designed to fit along the recess inner edge 50 of a building opening 12, for close positioning to a recessed window or door. See FIG. 1. One variation has leg members ! 34 extending through a shelf portion 56 spaced apart from anchor member 32, and working space 26 is the U-shaped channel space between shelf portion 56 and anchor member 32. See FIGS. 2 and 3. Shelf portion 56 and anchor member 32 are interconnected by a flange or right angle plate 40. Right angle plate 40 fastens or otherwise connects to inner edge 50. A spacer member 114 may replace shelf portion 56 to create working space 26. See FIG. 10. Another variation is to eliminate shelf portion 56 and instead weld or glue threaded leg receiving tube segments 152 to anchor member 32. See FIG. 8. Once again, the use of receiving tube segments 152 eliminates the need for a working space 26, because leg members 34 do not pass through anchor member 32. Anchor member 32 rests flat against the window or door frame. Finally, leg members 34 may be bent extensions of anchor member 32, so that no working space 26 is necessary. See FIGS. 5 and 6.

First Preferred Embodiment

In a preferred embodiment of assembly 30, anchor member 32 includes a substantially right angle plate 40, sometimes called an angle iron, having a first angle portion 42 for abutting a window frame 44 extending around a building opening 12. See FIGS. 2 and 3. A second angle portion 46 or flange abuts an inner edge 50 surrounding the building opening 12. A fastener 54 is provided for fastening the second angle portion 46 to inner edge 50. A shelf portion 56 is spaced apart from and substantially parallel to first angle portion 42 to create work space 26. Shelf portion 56 has two shelf ends 62, and a shelf leg slot 64 at each said shelf end 62. Shelf leg slot 64 is preferably a slot extending axially to the edge of an end 62. Leg members 34 are carriage bolts 34 extending through shelf leg slots 64 and away from window frame 44 and secured with bolt heads and nuts 72. Brace member 22 fits between bolts 34 and against shelf portion 56. Retaining member 36 is a plate having plate openings 66 through which leg members 34 extend, and wing nuts 86 are provided for fastening retaining member 36 over the given brace member 22. The retaining member 36 preferably has a wider portion 74 for extending between leg members 34 and having flanges 76 at each side for fitting around anchor member 32. Retaining member 36 also includes a narrower portion 82 with flanges 84 at along each side for fitting around a brace member 22, to achieve more secure gripping of the brace member 22. Nuts 86 for fastening retaining member 36 are preferably wing nuts, so that they can be secured without the need for a wrench or other tool.

Second Preferred Embodiment

In another variation of assembly 30 for an outer wall surface, anchor member 32 includes an elongate plate 102 having two anchor ends 104 and a leg slot 16 in each anchor end 104. See FIG. 4. Plate 102 has a first face 112 against which a spacer member 114 is placed. Spacer member 114 is shorter than plate 102 and the two anchor ends 104 extend beyond spacer member 114, creating a working spaces 26 at each anchor end 104. Spacer member 114 abuts a wall of the building adjacent to the opening 12. Elongate plate 102 also has a second face 116 against which an end of a brace member 22 is placed. Leg members 34 are bolts 34 extending through the leg slots 16 away from the wall of the building. Retaining member 36 is also an elongate plate 120, having two retaining member ends and a hole 122 in each retaining member end through which leg members 34 are fitted. Retaining nuts 124 are provided for fitting onto leg members 34 to fasten retaining member 36 over leg members 34 to hold brace member 22 in place.

Third Preferred Embodiment

Assembly 30 may equivalently include a U-shaped plate 130 wherein anchor member 32 includes the bottom segment 132 of plate 130. See FIG. 5. In this outer wall surface version, anchor ports 106 are provided in bottom segment 132 through which wall anchor elements 134 extend. Leg members 34 include the side segments 138 of plate 130, which have opposing leg openings 142 spaced apart from bottom segment 132. Retaining member 36 is preferably a rod member 136 extending through leg openings 142. Rod member 136 preferably has two rod ends and threads 144 on each rod end over which nuts 146 are fastened to laterally abut leg members 34.

Fourth Preferred Embodiment

A version of assembly 30 for an opening 12 inner edge 50 may once again include a U-shaped plate 130. Anchor member 32 includes the bottom segment 132 of plate 130 and a substantially right angle portion 150 extending along a longitudinal edge of bottom segment 132. See FIG. 6. Anchor ports 106 are provided in right angle portion 150 through which wall anchor elements 134 extend. Leg members 34 include the side segments 138 of plate 130. Leg members 34 have opposing leg openings 142 spaced apart from bottom segment 132, and retaining member 36 is a rod member 136 extending through leg openings 142.

Fifth Preferred Embodiment

Alternatively, anchor member 32 is an elongate plate 102 having a three anchor ports 106 for receiving wall anchor elements 134. See FIG. 7. This assembly 30 variation is for use on a wall outer surface. Plate 102 has a first face 112 for abutting a wall of the building adjacent to an opening 12. Plate 102 also has a second face 116 against which an end of brace member 22 is placed. Leg members 34 include two spaced-apart and internally threaded tube segments 152 projecting substantially perpendicularly from second face 116. Two bolts 154 are provided for screwing into tube segments 152. Retaining member 36 is also an elongate plate 120 having two retaining member ends and a hole 122 in each end through which the two bolts 154 are fitted. Bolts 154 fasten plate 120 over tube segments 152 to hold brace member 22 in place.

Sixth Preferred Embodiment

Figure 7:
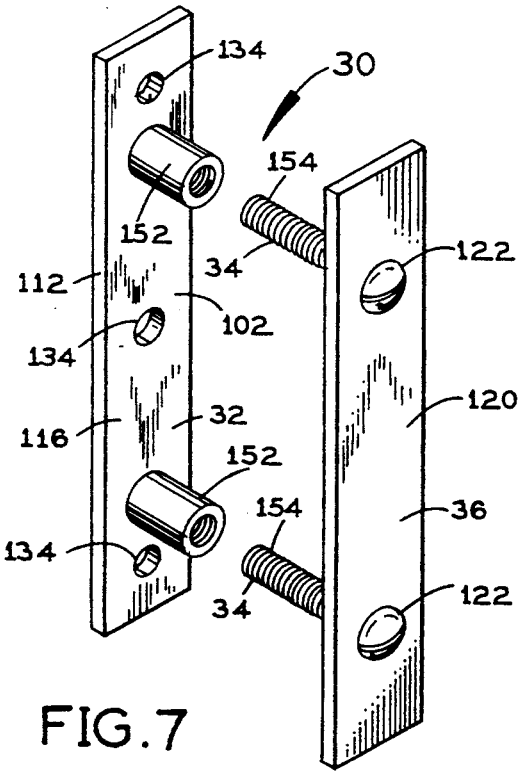
Figure 8:
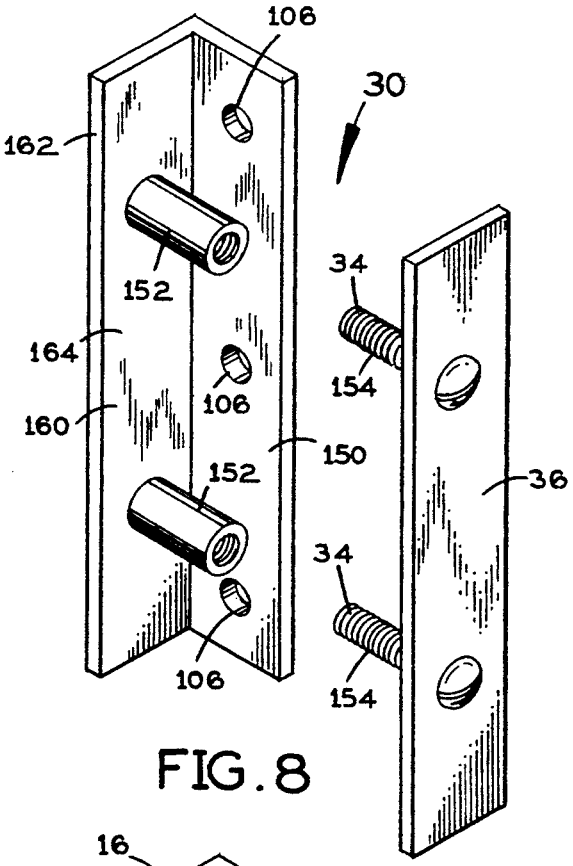
Figure 9:
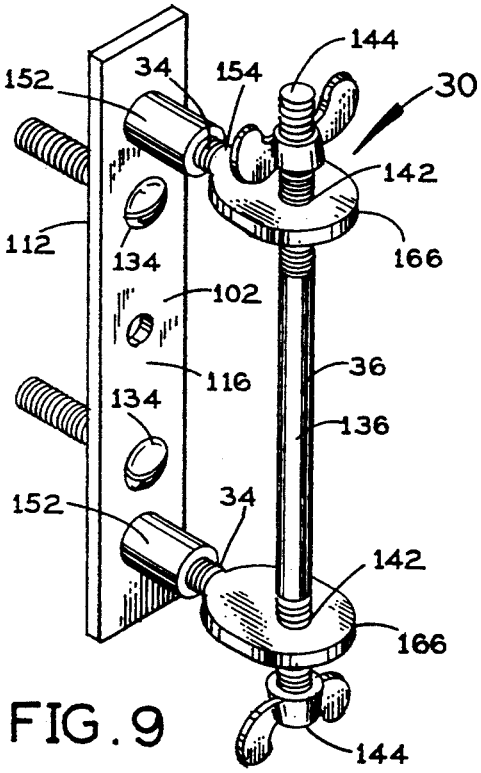
Figure 10:
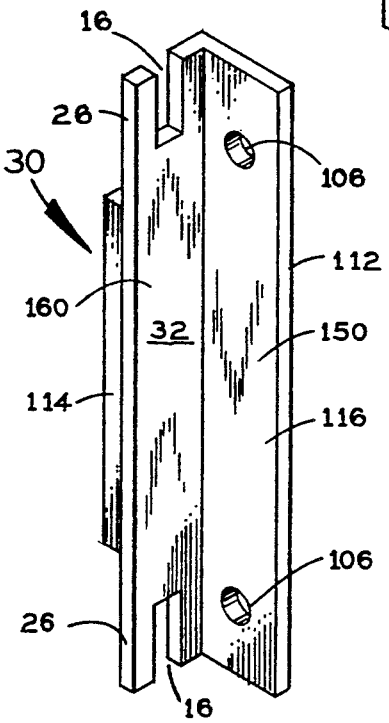

The design of FIG. 7 can be adapted for use on an opening 12 inner edge 50. In this instance, anchor member 32 includes a wall plate 150 having three anchor ports 106 for receiving wall anchor elements 134. See FIG. 8. A connecting plate 160 extends substantially perpendicularly from wall plate 150 and has a first face 162 for abutting a wall of the building adjacent to an opening 12. Plate 160 also has a second face 164 against which an end of a brace member 22 is placed. Leg members 34 include two spaced-apart and internally threaded tube segments 152 projecting substantially perpendicularly from second face 164, and two bolts 154 for screwing into tube segments 152. Retaining member 36 is also an elongate plate 120 having two retaining member ends and a hole 122 in each end. A bolt 154 is fitted through each hole 122 to fasten retaining member 36 over tube segments 152 to hold the brace member 22 in place.

Seventh Preferred Embodiment

The design of FIG. 7 can be altered to use a rod rather than a plate as a retaining member 36. Anchor member 32 is an elongate plate 102 having three anchor ports 106 for receiving wall anchor elements 134. See FIG. 9. Plate 102 has a first face 112 for abutting a wall of the building adjacent to an opening 12. Plate 102 also has a second face 116 against which an end of brace member 22 is placed. Leg members 34 include two spaced-apart and internally threaded tube segments 152 projecting substantially perpendicularly from second face 116 and two wing bolts 154, each having a diametrical bore 142 through the wing portion 166 for screwing into tube segments 152. Retaining member 36 is preferably a rod member 136 which fits through diametrical bores 142 and has threads 144 at each end to receive nuts to secure rod member 136 within diametrical bores 142. This in turn retains rod member 136 over tube segments 152 to hold the anchor member 32 in place.

Eighth Preferred Embodiment

The design of FIG. 4 can be converted for use on an opening 12 inner edge 50. See FIG. 10. Anchor member 32 includes a wall plate 150 having an anchor port 106 extending there-through and a substantially perpendicular connecting plate 160 extending from one of its longitudinal edges. A leg slot 16 is provided in each of the two plate 150 ends. Wall plate 150 has a first face 112 against which a spacer member 114 is placed. Spacer member 114 is shorter than plate 150 and the two plate 150 ends extend axially beyond the ends of spacer member 114. Spacer member 114 abuts a wall of the building adjacent to an opening 12 and creates a working space 26 at each plate 150 end. Plate 150 also has a second face 116 against which an end of brace member 22 is placed. Leg members 34 are preferably bolts 34 extending through anchor slots 172 away from the wall of the building. Retaining member 36 is also an elongate plate 120 having two retaining member ends and a hole 122 in each end through which leg members 34 are fitted. Nuts 124 are preferably provided for fitting onto leg members 34 to fasten retaining member 36over leg members 34 to hold brace member 22 in place.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A storm shutter apparatus for protectively covering openings in buildings such as windows and doors, comprising:

a panel member for fitting over a building opening, a brace member having an end and extending across said panel member, means for removably securing said end of said brace member to said building adjacent to said building opening, said means comprising an anchor member for attaching to said building, two spaced-apart leg members extending from said anchor member for receiving between them said end of said brace member, a retaining member removably secured over said end of said brace member for retaining said end between said leg members.

2. An apparatus according to claim 1, wherein said brace member is a unified part of said panel member.

3. An apparatus according to claim 1, wherein said brace member is attached to said panel member.

4. An apparatus according to claim 1, wherein said brace member is a separate member placed over said panel member.

5. An apparatus according to claim 1, wherein said anchor member comprises an angle iron plate, having a first angle portion for abutting a window frame fitted within said building opening, a second angle portion substantially perpendicular to said first angle portion for abutting an inner edge of said building opening, fastener means for fastening said second angle portion to said inner edge, and a shelf portion extending from said second angle portion and spaced-apart from and substantially parallel to said first angle portion and having two shelf ends and a shelf opening at each said shelf end, wherein said leg members are bolts extending through said shelf openings away from said frame, said brace member fitting between said bolts and against said shelf portion, wherein said retaining member is a plate having plate openings for receiving said leg members, and nuts for fastening said retaining member over said brace member.

6. An apparatus according to claim 5, wherein said retaining member has a wider portion for extending between said leg members and extending around said anchor member, and a narrower portion with flanges at each end for fitting around said end of said brace member for more secure gripping of said brace member.

7. An apparatus according to claim 5, wherein said nuts for fastening said retaining member are wing nuts for securing without the need for a tool.

8. An apparatus according to claim 1, wherein said anchor member comprises an elongate plate having two anchor ends and an anchor port in each of said two anchor ends, and having a first face against which a spacer member is placed, said spacer member being shorter than said anchor member and said two anchor ends extending axially beyond said spacer member, said spacer member abutting a wall of said building adjacent to said opening, said elongate plate also having a second face against which said end of said brace member is placed, wherein said leg members are bolts extending through said anchor ports away from said wall of said building, and wherein said retaining member is also an elongate plate having two retaining member ends and a hole in each said retaining member end through which said leg members are fitted, and comprising bolts for fitting onto said leg members to fasten said retaining member over said leg members to hold said brace member in place.

9. An apparatus according to claim 1, comprising a U-shaped plate wherein said anchor member comprises the bottom segment of said plate, and anchor ports are provided in said bottom segment of said plate through which wall anchor elements extend, and the side segments of said U-shape comprise said leg members, said leg members having opposing leg openings spaced out from said bottom segments, and wherein said retaining member is a rod member extending through said leg openings.

10. An apparatus according to claim 9, wherein said rod member has two rod ends and threads on each said rod end over which nuts are fastened to laterally abut said leg members.

11. An apparatus according to claim 1, comprising a U-shaped plate wherein said anchor member comprises the bottom segment of said plate and a wall portion extending substantially perpendicular to and along an edge of said bottom segment to form a right angle portion, and anchor ports are provided in said right angle portion through which wall anchor elements extend, wherein said leg members comprise U-shaped plate side segments, said leg members having opposing leg openings spaced-apart from said bottom segment, and wherein said retaining member is a rod member extending through said leg openings.

12. An apparatus according to claim 1, wherein said anchor member comprises an elongate plate having a plurality of anchor ports for receiving wall anchor elements, and having a first face for abutting a wall of said building adjacent to said opening, said elongate plate also having a second face against which said end of said brace member is placed, wherein said leg members comprise two spaced apart and internally threaded tube segments projecting substantially perpendicularly from said second face and two bolts for screwing into said tube segments, and wherein said retaining member comprises an elongate plate having two retaining member ends and a hole in each said retaining member end through which said two bolts are fitted to fasten said retaining member over said tube segments to hold said brace member in place.

13. An apparatus according to claim 12, wherein said anchor member additionally comprises a wall angle portion extending substantially perpendicularly from said plate.

14. An apparatus according to claim 1, wherein said anchor member comprises an elongate wall plate having a plurality of anchor ports for receiving wall anchor elements, and a connecting plate extending substantially perpendicularly from said wall plate and having a first face for abutting a wall of said building adjacent to said opening, said elongate plate also having a second face against which said end of said brace member is placed, wherein said leg members comprise two spaced apart and internally threaded tube segments projecting substantially perpendicularly from said second face and two bolts for screwing into said tube segments, and wherein said retaining member comprises an elongate plate having two retaining member ends and a hole in each said retaining member end through which said two bolts are fitted to fasten said retaining member over said tube segments to hold said brace member in place.

15. An apparatus according to claim 1, wherein said anchor member comprises an elongate plate having a plurality of anchor ports for receiving wall anchor elements, and having a first face for abutting a wall of said building adjacent to said opening, said elongate plate also having a second face against which said end of said brace member is placed, wherein said leg members comprise two spaced apart and internally threaded tube segments projecting substantially perpendicularly from said second face and two bolts each having a diametrical bore for screwing into said tube segments, and wherein said retaining member is a rod member fitting through said diametrical bores in said bolts having fastening means at one end to secure said rod member within said diametrical bores to retain said rod member over said tube segments to hold said brace member in place.

16. An apparatus according to claim 1, wherein said anchor member comprises a wall plate having an anchor bore extending there-through and a substantially perpendicular connecting plate attached thereto and having two anchor ends and an anchor opening in each of said two anchor ends, and having a first face against which a spacer member is placed, said spacer member being shorter than said anchor member and said two anchor ends extending axially beyond said spacer member, said spacer member abutting a wall of said building adjacent to said opening, said elongate plate also having a second face against which said end of said brace member is placed, wherein said leg members are bolts extending through said anchor openings away from said wall of said building, and wherein said retaining member is also an elongate plate having two retaining member ends and a hole in each said retaining member end through which said leg members are fitted, and bolts for fitting onto said leg members to fasten said retaining member over said leg members to hold said brace member in place.

* * * * *